United States Patent [19]

Heim et al.

[11] 4,456,065

[45] Jun. 26, 1984

[54] HEAVY OIL RECOVERING

[75] Inventors: Werner Heim, Zollikon; Fritz J. Wolf, Zollikerberg, both of Switzerland; Winsor T. Savery, The Woodlands, Tex.

[73] Assignee: Elektra Energie A.G., Zollikon, Switzerland

[21] Appl. No.: 294,629

[22] Filed: Aug. 20, 1981

[51] Int. Cl.[3] ..... E21B 43/24

[52] U.S. Cl. ..... 166/248; 166/252; 166/272

[58] Field of Search ..... 166/50, 60, 245, 249, 166/248, 252, 272, 274, 263; 175/61

[56] References Cited

U.S. PATENT DOCUMENTS

| | | | |
|---|---|---|---|
| 3,137,347 | 6/1964 | Parker | 166/60 |
| 3,221,811 | 12/1965 | Prats | 166/245 |
| 3,386,508 | 6/1968 | Bielstein et al. | 166/272 |
| 3,504,745 | 4/1970 | Elkins | 166/261 |
| 3,513,913 | 5/1970 | Bruist | 166/245 |
| 3,682,244 | 8/1972 | Bowman et al. | 166/252 |
| 3,967,853 | 7/1976 | Closmann et al. | 166/272 |
| 4,084,637 | 4/1978 | Todd | 166/272 |
| 4,140,179 | 2/1979 | Kasevich | 166/248 |
| 4,191,252 | 3/1980 | Buckley et al. | 166/272 |
| 4,319,632 | 3/1982 | Marr, Jr. | 166/272 |

*Primary Examiner*—Stephen J. Novosad
*Assistant Examiner*—William P. Neuder
*Attorney, Agent, or Firm*—Jerry Cohen

[57] ABSTRACT

In a section of an oil field a first and only bore hole (5) is drilled through the strata (3) carrying heavy oil until the underlying stratum (4) void of heavy oil and enlarged to a cavern-like collection chamber (9). Around this first bore hole (5) a plurality of second bore holes (6) are drilled through the strata (3) carrying heavy oil to the stratum (4) in a pattern comprising several circles. A further pattern of third bore holes (7) is drilled also in a circle-like pattern through the strata (5) carrying heavy oil, which third bore holes (7) are followed by drainage channels (8), which extend to the collecting chamber (9). By means of electrodes arranged in the second bore holes (6) the heavy oil strata are preheated and thereafter steam is injected through the same bore holes (6) in order to drive flowable heavy oil against the third bore holes (7). A solvent is injected from the third bore holes (7) into the cone-like heavy oil accumulation (18) and by means of a further injection of steam from the second bore holes (6) the heavy oil rendered flowable by the solvent is driven toward the third bore holes (7) such to flow into the collecting chamber (9) out of which it is finally pumped to the first bore hole (6).

20 Claims, 10 Drawing Figures

HEAVY OIL RECOVERING

BACKGROUND OF THE INVENTION

The invention refers to a method of recovering heavy oil from a section of an oil field containing strata of oil shale or tar sand. Deposits of heavy oil which comprise oil shale from which kerogen can be recovered or oil sand from which bitumen can be recovered feature in common the drawback that no natural gas pressure is present, which drives the matter to be recovered toward the ground surface. Presently said deposits of heavy oil are mined by conventional mining methods and usually the heavy oil is recovered by means of a retorting method in plants located distant from said heavy oil deposits. This procedure is extremely costly, specifically because the mined crude rock must be transported from the respective heavy oil deposit to the processing plant and thereafter the depleted residues must be again transported back for a depositing thereof or must be transported to a different location.

Several methods by means of which the recovering of the heavy oil can be carried out directly at the location of the deposits have been proposed.

In U.S. Pat. No. 2,757,738 (Ritchey) sections of oil fields are heated by means of radio frequency waves to render the heavy oil flowable for the recovery thereof. However, this method has not succeeded in practice because the local heating in the area surrounding immediately the electrodes in order to generate the radio frequency waves has been to such a large extent that a coking of the crude oil occurred.

It is proposed in U.S. Pat. 3,538,488 to treat sections of oil fields by means of inserted steam to render the heavy oil flowable. However, this method is often impeded by the phenomenon that the steam following the path of the least resistance blows through from one bore hole to another bore hole such that only a limited section of the heavy oil containing strata is heated. Then, only a small percent of the heavy oil can be recovered because the sections of the strata containing heavy oil located at a distance from the channels flowed through by the steam are not heated and accordingly their heavy oil contents are not rendered flowable. This phenomenon of the blowing through of the steam is known in the art as "override" or "fingering".

U.S. Pat. No. 3,881,550 describes the utilization of solvents which can be manufactured at the oil field in an inexpensive way and by means of which the viscosity of the heavy oil may be lowered. According to the disclosure of this patent specification the solvents for the heavy oil are injected at a high temperature and consequently lie on top of the oil shale or tar sand strata and accordingly no complete mixing and dissolving of the heavy oil takes place.

The prior art also includes:

(a) above ground processing after mining tar sands or shale from depths of 200 to 1000 feet or for producing below ground retorts, e.g. by electropneumatic or electrolytic mining or fracturing as disclosed in U.S. Pat. Nos. 3,696,866 (Dryden/Bureau of Mines) granted Oct. 10, 1972, 3,103,975 (Hanson/Dow) granted Sept. 17, 1973, and 4,120,776 (Miller, Univ. of Utah) granted Oct. 17, 1978, tailored to Utah sands; see also 4,160,720;

(b) means for exploding shale or sands underground and drawing oil from resultant rubble chambers, e.g. as disclosed in U.S. Pat. Nos. 3,578,080 (Closmann/Shell Oil) granted May 11, 1971; 3,692,110 (Grady/Cities Service) granted Sept. 19, 1972; 3,698,478 (Parker/Phillips Petroleum) granted Oct. 17, 1972; 4,061,190 (Bloomfield/NASA) granted Dec. 6, 1977 (laser retorting);

(c) propagation of pulsating energy waves for heating oil, e.g. as disclosed in U.S. Pat. No. 3,718,186 (Brandon) granted Feb.27, 1973, (d) variations of electro-conductive, inductive or rf heating as disclosed in U.S. Pat. No. 3,848,671 (Kern-/Arco) granted Nov. 19, 1974 [see also Kern's 1975 U.S. Pat. Nos. 3,862,662, 3,874,450 and 3,920,072]; 3,948,319 (Pritchett/Arco) granted Apr. 6, 1976; 3,972,372, 3,989,107 and 4,008,761 and 2 Fisher) granted Aug. 3, 1976, and Feb. 22, 1977 [see also 4,049,053]; 4,010,799 (Kern/Petro-Canada, Imperial Oil, Cities Service) granted Mar. 8, 1977; Raytheon's U.S. Pat. Nos. 4,140,179 granted Feb. 20, 1979, 4,135,579 granted Jan. 23, 1979, and 4,193,451 and 4,196,329 granted Mar. 18 and Apr. 1, 1980;

(e) variations of pressures, steam or water injection cycles or production, injection well (and in some instances separate electrode well) spacings and arrangements, e.g. as disclosed in U.S. Pat. Nos. 4,084,637 (Todd/Petro Canada, Cities Service, Imperial Oil) granted Apr. 18, 1978; 3,946,809 (Hagedorn/Exxon) granted Mar. 30, 1976; 3,958,636 (Perkins/Arco) granted May 25, 1976; 4,133,382 (Cram/Texaco) granted Jan. 9, 1979;

(f) in situ gas generation; e.g. as in U.S. Pat. No. 4,037,655 and 4,199,025 (Carpenter/Electro Flood Co.) granted July 26, 1977, and Apr. 22, 1980;

(g) in situ combustion or dielectric heating, e.g. in U.S. Pat. No. 2,818,118 (Dixon/Phillips Petroleum) granted Dec. 31, 1957 ]see also 2,889,882, 2,994,377] and 4,140,180 and 4,144,935 (Bridges/I.I.T.) granted Feb. 20 and Mar. 20, 1979;

(h) complex means for analysis of flooding progress as disclosed e.g. in U.S. Pat. No. 4,085,798 (Schweitzer et al/Schlumberger) granted Apr. 25, 1978, and references cited therein.

(i) variations of solvent treatment e.g. as in U.S. Pat. No. 4,141,415 (Wu/Texaco) granted Feb. 27, 1979;

(j) electrical heating as in U.S. Pat. Nos. 3,507,330, 3,547,193, 3,620,300, 3,605,888, 3,642,066 (Gill et al/-T.E.C.).

The diversity and intensity of the underlying development efforts (and incidental patent activity illustrated above) show the high economic stakes and long felt needs (substantially unfulfilled or only partially fulfilled, as illustrated by cross-critiques in the introductions of the various patents above) for economic, effective and practical oil recovery processes usable in shale and/or tar sand regions.

It is a principal object of this invention to provide oil recovery method and apparatus fulfilling one or more of such needs.

It is a further particular object of this invention, consistent with the first stated object, to suppress overriding (aka channeling or fingering).

It is a further particular object of this invention, consistent with the first stated object, to avoid problems of well clogging.

It is a further particular object of this invention, consistent with the first stated object, to limit the need for expensive or complex equipment.

It is a further particular object of this invention, consistent with the first stated object, to limit the number of maintenance cycles or the extent of interference with production occasioned by such cycles.

It is a further particular object of this invention, consistent with the first stated object, to more effectively utilize solvents in oil recovery and to lower critical specifications or cost of solvent usage.

It is a further particular object of this invention, consistent with the first stated object, to provide step by step working of an area for efficient usage of limited equipment resources.

It is a further particular object of this invention, consistent with the first stated object, to provide simple and economic means for process monitoring and control.

SUMMARY OF THE INVENTION

In accordance with the present invention, heavy oil is recovered from a section of an oil field containing strata of oil shale or tar sand by the method comprising the steps of drilling a first bore hole through said strata down into the underlying strata void of heavy oil, enlarging the end section of said first bore hole located in said underlying stratum to provide a collecting chamber, drilling adjacent to said first bore hole a plurality of second bore holes through said heavy oil containing strata in a pattern surrounding said first bore hole, drilling at locations between said second bore holes in the pattern surrounding said first bore hole a plurality of third bore holes through said heavy oil containing strata, each said third bore holes being followed by a drainage channel leading to said collecting chamber, preheating a section of said oil shale or tar sand strata located between said second and third bore holes by means of radio frequency waves or by an electrical resistance heating, applying a pressure with simultaneous exertion of further heat, said pressure being directed from said second bore holes to said third bore holes, whereby heavy oil rendered flowable thereby is transported towards the said third bore holes to flow therein through said drainage channels and into said collecting chamber to be extracted therefrom through said first bore hole, thereafter terminating said application of heat and pressure and subjecting said oil shale or tar sand strata repeatedly to a scavenging action to extract further heavy oil, filling the depleted section of said strata by a foamed material.

The applying of pressure with simultaneous exertion of heat can be carried out advantageously by steam injected into said second bore holes.

In accordance with a further advantageous embodiment of the method a vertically extending fire front is generated at said second bore holes, whereby the combustion gases stemming therefrom can generate the pressure with simultaneous exertion of heat.

Throughout the above mentioned variations of the invention temperature (or other parameters) can be measured at each of the third bore holes to detect the beginnings of channeling and in response thereto, the peripheral resistance of any such third bore hole can be varied by such measures as closing a spool valve therein. Channeling can also be restrained by varying the selection of "second" bore holes through which to generate driving pressures and/or by varying heating (or other) conditions. Such control can be implemented at specific levels of the second and third bore holes; shale formations substantially define segregated pay zones at different levels within an overall oil-containing zone, each pay zone being therefore, substantially separately controllable.

Solvent can be injected into the third bore holes to loosen up heavy oil driven into cone-like (apex up) formations around the third bore holes through one or more of the above described driving operations. The solvent can move from layer to layer within shale (although as noted above, heavy oil does not do so to any substantial degree). The solvent can optionally be any of a variety of inexpensive solvents (rather than the high grade, inexpensive solvents now used). The solvent mixes well with the oil and is therefore more effectively used than top layer applied solvents of the prior art. The solvent mixes well with the core oil formation and renders the oil more flowable, generally loosening and widening the core. Through renewed driving operations, conducted simultaneously with solvent injection or immediately thereafter, the oil is driven to and into the third bore holes. The additional collected oil is drained into the collecting chamber and pumped therefrom.

The above described filling of depleted areas by foam or other filler can then be conducted and electrodes, pumps, bore hole liners (if any) and spool valves can be withdrawn from the then worked out region for use in another region.

The invention can be practiced with heating of the oil at low enough levels to avoid coking. It comprises an effective approach to limit over-ride. The expense and environmental effects of above ground processing and underground explosion are avoided. Low energy requirements are involved herein compared to most state of the art methods. Inexpensive pumping equipment can be utilized for the collection chamber because direct pumping out of the narrow second or third bore holes is avoided. Clogging vulnerability of pumps is also reduced through the present invention.

Further objects, features and advantages of the invention will be apparent from the following description of preferred embodiments thereof taken in conjunction with the accompanying drawing, in which,

DETAILED DESCRIPTION OF PREFERRED EMBODIMENTS

Figure 1:
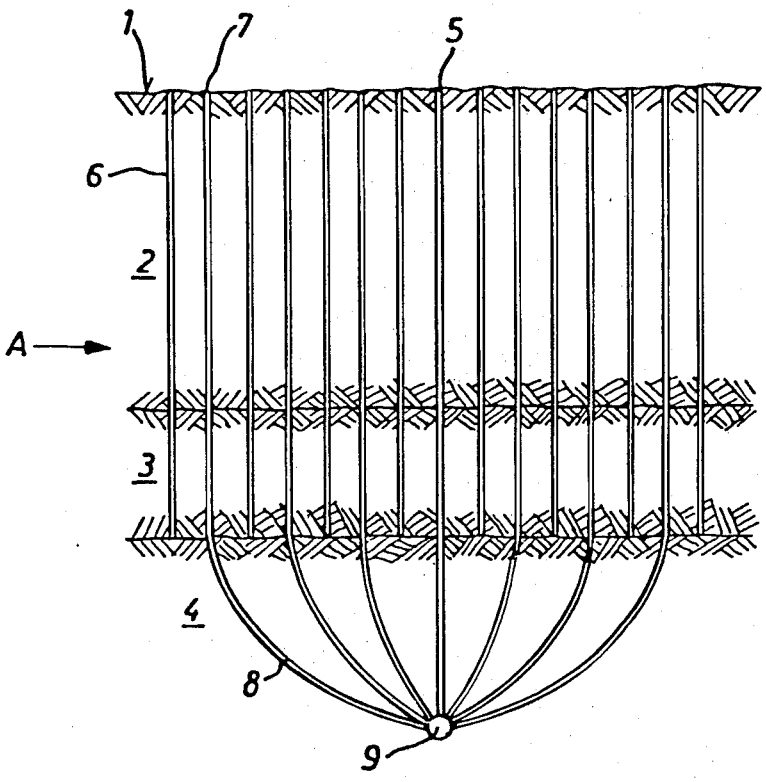
FIG. 1 shows a vertically extending section through a section of an oil shale or tar sand.
Figure 2:
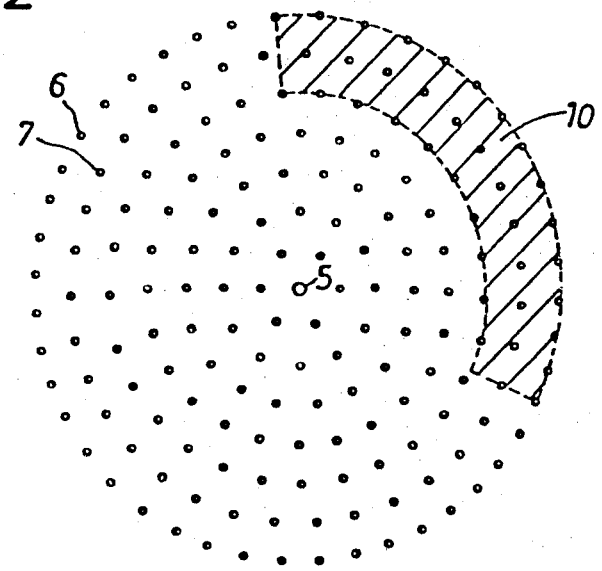
FIG. 2 shows a plan view of the oil field shown in FIG. 1.

Attention is now drawn to FIGS. 1 and 2. In FIG. 1 there is shown a vertical section through an oil field. The ground surface is designated by the reference numeral 1. Reference numeral 2 designates the so-called overburden comprising the strata containing no heavy oil which is located between the ground surface 1 and the strata 3 containing heavy oil. The thickness of this strata can amount to a few meters. Furthermore there is shown the stratum 4 void of heavy oil located under the strata 3 containing heavy oil.

In the chosen section of the oil field there is drilled firstly in its center a first bore hole 5, which hereafter is designated as collection hole 5. This collecting hole 5 is drilled in this embodiment of a high pressurized water drilling technique and extends through the overburden 2, through the section 3 of the strata carrying heavy oil down into the stratum 4 void of heavy oil. At the lower end of this collecting hole 5 a cavern-like collecting chamber 9 is formed again by means of the known high pressure water drilling method. The diameter of the first bore hole 5 is for instance 25 cm and the diameter of the collecting chamber 9 amounts to about 6 m. A not particularly shown pump is arranged in this collecting chamber 9 by means of which pump any material flowing into the collecting chamber 9 and being collected therein is extracted through the first bore hole 5.

A plurality of second bore holes 6 are drilled around the first bore hole 5 and through the strata 3 containing heavy oil and, in accordance with FIG. 2, in a pattern surrounding the first bore hole 5, which pattern in the present embodiment is described by concentric circles. These second bore holes 2 are identified hereinafter as injection holes 6. According to FIG. 1 these injection holes 6 extend merely until the lower limit of the strata 3 containing heavy oil and not into the stratum 4 void of heavy oil. The diameter of these injection holes 6 amounts for instance to 10 cm, may however be considerably smaller.

Thereafter third bore holes 7 are drilled through the strata 3 containing heavy oil. These are again arranged in a pattern surrounding the collecting hole 5, whereby every third bore hole 7 is located insofar between the injection holes 6, in that they are located also along concentric circular lines such as may be seen from FIG. 2. These third bore holes 7 are identified hereinafter as production holes 7. These production holes 7 are followed each by a drainage channel 8 which extends to the collecting chamber 9 of the first bore hole 5. In this context attention is drawn to FIG. 1, whereby it must be noted that the drawn course of this drainage channels is an example only, they may extend in a straight line and comprise a relatively abrupt transition to the respective production holes 7. The diameter of the production holes 7 is the same as in the case of the injection holes 6. The horizonal extent of this oil field containing this plurality of bore holes amounts for instance in every direction to about 125 m, which extent corresponds in FIG. 2 to the diameter of the outermost circular line which is defined by the injection holes 6 having the largest distance from the collecting hole 5. The distance between consecutive bore holes seen in radical direction of the oil field to be handled amounts in this embodiment to about 20 m.

Figure 3:
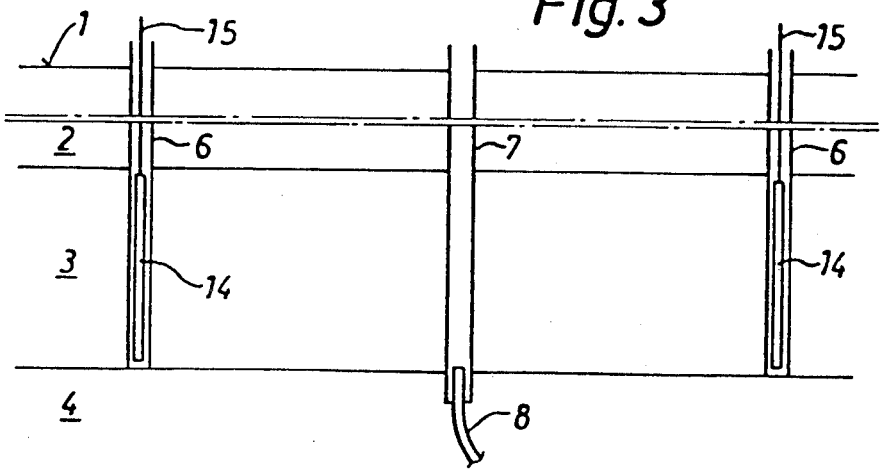
FIG. 3 shows on an enlarged scale the detail A of FIG. 1 whereby the electrodes for the resistance heating of the section are drawn.

Attention is now drawn to FIGS. 2 and 3. The method is now carried out in discrete annular sections 10 of the oil field such as shown in FIG. 2. Such an annular section is defined seen in a radial direction towards the outside and towards the inside each of a series of injection holes 6 which are located at two concentric sections of circular lines, whereby a series of production holes 7 are arranged therebetween and also along a section of a circular line. The oil field is now mined annular section by annular section, whereby it shall be noted already in this instance that each completely mined annular section 10 is filled by means of a foamed material.

Figure 5:
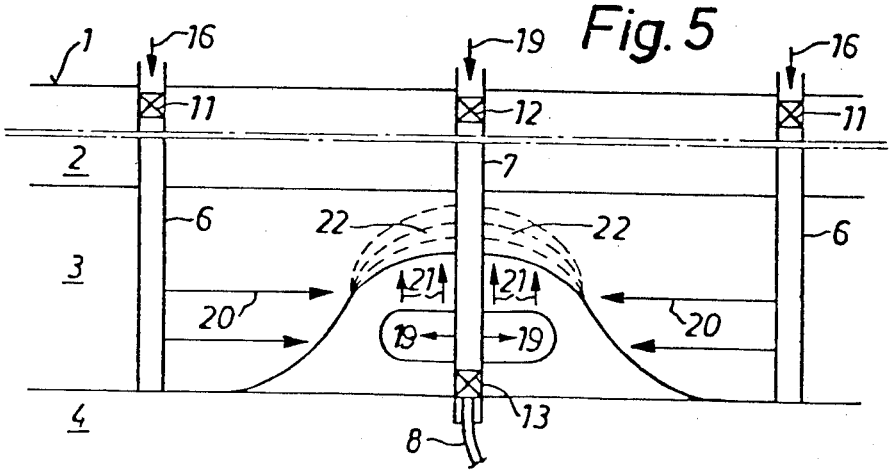
FIG. 5 shows a section similar to the section of FIG. 3, whereby there is shown the injection of solvents.

In FIG. 3 the detail A of FIG. 1 is shown on an enlarged scale, whereby the section drawn extends along a radial line of the FIG. 5 through an annular section 10.

In FIG. 3 there is shown again the ground surface 1, the overburden 2, the section of the strata 3 containing heavy oil as well as the underlying stratum 4 void of heavy oil. Furthermore there are drawn two injection holes 6, between which there is located a production hole 7 including its drainage channel 8. In order to carry out the first step of the method electrodes 14 located in the injection holes 6 are used, which electrodes 14 are provided with feed lines 15. By means of these electrodes 14 the strata 3 containing heavy oil are heated by means of radio frequency waves or by means of an electrical resistance heating to carry out the preheating thereof. In order now to avoid a local overheating of the strata 3 containing heavy oil at locations immediately adjacent the injection holes 6 a cooling fluid is injected through these injection holes 6 during the preheating. Thereby a local coking of the heavy oil is avoided. By means of this preheating a part of the heavy oil may be rendered already flowable. This portion of the flowable heavy oil flows through the production hole 7 and down through the drainage channel 8 into the collecting chamber 9, out of which collecting chamber 9 such heavy oil is extracted by means of the not shown pump through the collecting hole 5.

Figure 4:
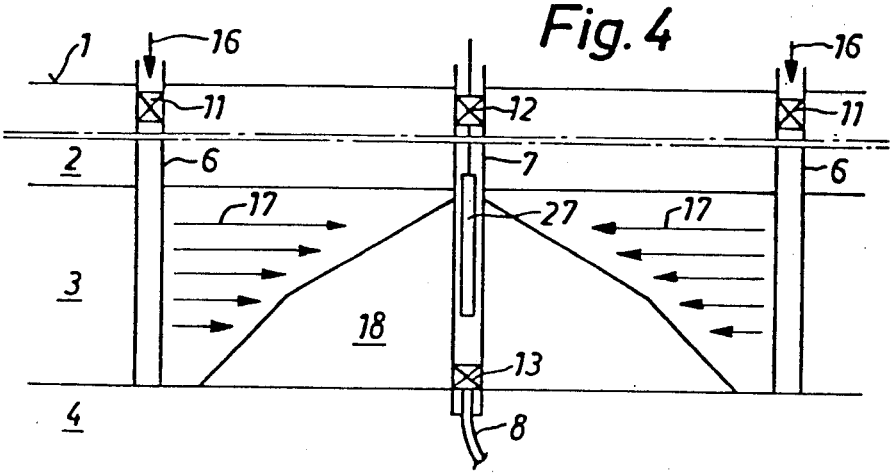
FIG. 4 shows a section similar to the section of FIG. 3, whereby there is shown the injecting of steam.

The next following method step will now be explained by reference to FIG. 4. This FIG. 4 corresponds to a large extent to FIG. 3, whereby however closure- or valve members provided for the bore holes are shown schematically. Every injection hole 6 is provided with an injection valve 11, which is arranged at the upper end of each injection well 6. These valves 11 are not necessarily arranged below the ground surface 1 such as shown in the figure, they may be located above the ground surface 1 in a pipe stub connected to the injection hole 6. The same proves true also for the closure valve 12 of the production hole 7. A drainage valve 13 is located at the lower end of the production hole 7, by means of which the communication between the production hole 7 and its drainage channel 8 can be selectively interrupted or made, respectively.

After the preheating of the strata 3 carrying heavy oil by means of for instance radio frequency waves steam 16 is led to every injection hole 6. During the feeding of this steam the generation of radio frequency waves could be continued, which however is not absolutely necessary for carrying out the method. Out of the injection holes 6 the steam such as identified by the arrows 17 penetrates in the strata 3 carrying the heavy oil. It has now been mentioned previously that in accordance with methods of the prior art the injected steam 17 following the path of the least resistance flows relatively directly to the production hole 7, such that many portions of the strata 3 are bypassed such that they are not subjected to the pressure and the temperature of the injected steam. In order to avoid this phenomenon, "override" or "fingering" specific measures are taken in accordance with the present method. A temperature feeler 27 is arranged in every production hole 7. As soon as a direct flowing of steam 17 from an injection hole 6 to a production hole 7 occurs, the sudden increase of temperature in the production hole 7 is detected by the temperature feeler 27. The injection of steam 17 from the injection holes 6, i.e. the location of the discharge out of the injection holes 6 as well as the direction of discharge of the steam 17 is controlled. If now a direct flowing through of steam from the injection holes 6 to the production holes 7 occurs which is detected by the temperature feeler 27, the discharge locations of the steam 17 out of the injection holes 6 into the strata 3 containing heavy oil located closest to the respective production hole 7 will be shut off. In this way it is possible to change by means of a suitable selection of the locations of the discharge of the steam from the injection holes 6 into the strata 3 containing heavy oil as well as the direction of flow of the steam flowing out of the injection holes 6. By means of this controlled injection of the steam 17 a breaking through of the steam the production holes 7 is eliminated, such that the respective section of the oil field is heated uniformly and at all locations. During the injection of the steam from the injection holes 6 the drainage valve 13 at the lower end of the production hole 7 is kept shut. The heavy oil rendered flowable collects now obviously around the production hole 7 specifically because heavy oil rendered flowable and contained in the upper strata 3 flows obviously due to gravity forces downwards such that a cone-like gathering 18 of flowable heavy oil collects around every production hole 7. It is not specifically to be noted, that steam is injected mainly at the lower strata of the injection holes 6 adjacent to the stratrum 4 void of heavy oil such to keep specifically the lower section of the cone 18 of flowable heavy oil in a heated state.

Attention is now drawn to FIG. 5. From the lower section of the production hole 7 a heavy oil solvent, e.g. diesel oil is injected into the cone 18 of flowable heavy oil. Because the lower section of the cone 8 is held at a higher temperature as mentioned above the solvent can enter relatively easily out of the production hole 7 into the lower section of cone 18. It is now important to note that contrary to the prior art the injected solvent is cold and not heated. This solvent which is somewhat denser than the flowable heavy oil present in the cone 18 forms immediately after its injection out of the production hole 7 a pocket 19 at the base area of the cone 18. Further steam is injected from the injection holes 6 such as shown by means of the arrows 20, whereby contrary to the injected steam 17 of FIG. 4 the latter injected steam injected during the injection of the solvent acts only against a lower section of cone 18. Accordingly the heavy oil and the solvent located in the lower portion of the cone 18 are heated and rise in the direction of the arrows 21 towards the apex of the cone whereby a widening of the apex of the cone takes place such as is indicated in FIG. 5 by means of the reference numerals 22.

Figure 6:
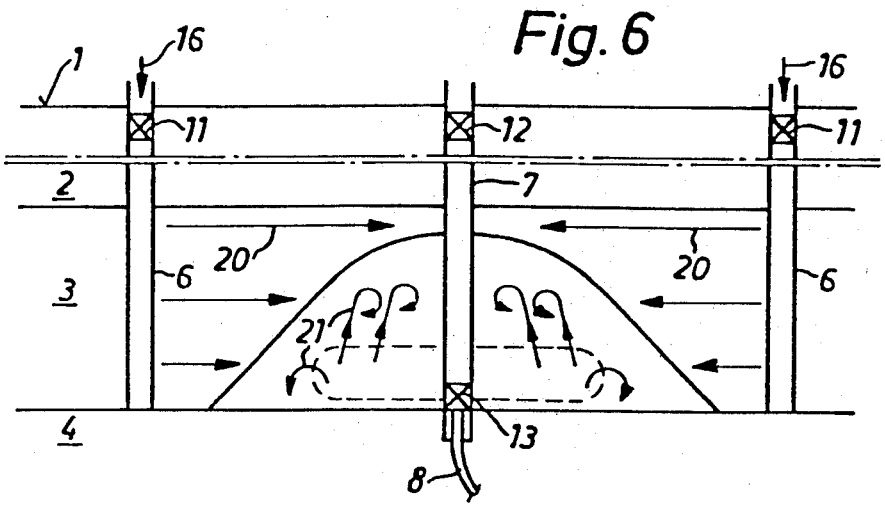
FIG. 6 shows a section similar to the section of FIG. 3, whereby there is shown the mixing between the heavy oil and the solvents.

Attention is now drawn to FIG. 6. The drainage valve 13 of the production hole 7 still being kept shut and during a continuing injection of steam the solvents mix thoroughly with the heavy oil of the cone, such as is shown by means of the arrows 21, such that a as large as possible intermixing is achieved. Thereby the viscosity of the heavy oil portions is lowered by a factor of 99% or more. In order to promote the mixing and heating further steam to enter is brought to act onto the complete height of the cone as is shown in FIG. 6.

Figure 7:
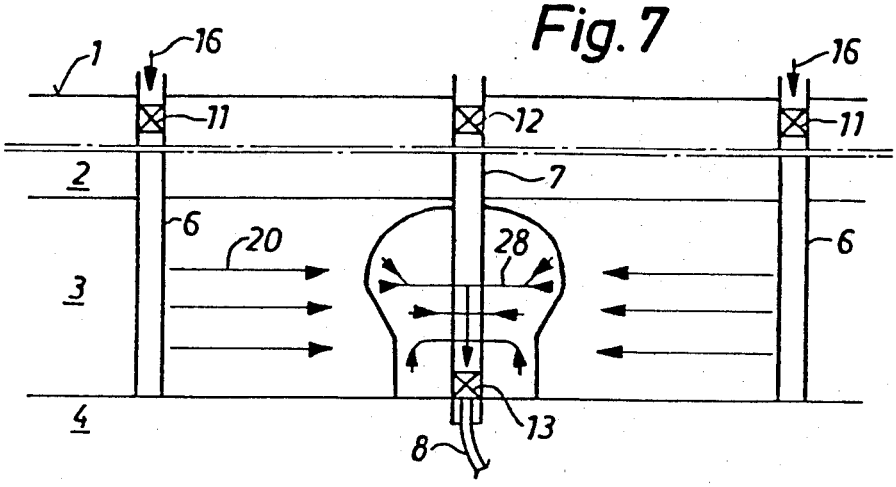
FIG. 7 shows a view similar to the view of FIG. 3, whereby the flowing off of the heavy oil which has been dissolved by the dissolving agents is shown.

The next following step is shown in FIG. 7. The steam 20 injected from the injection holes 6 is brought to act merely again against the lower section of the previous cone 18 containing dissolved heavy oil. The purpose of this is to let the upper portion of the strata containing heavy oil to cool off such that a sealing off against a not wanted flowing out of steam (override) is achieved. However, the lower part of the strata of the cone 18 are heated further by means of injected steam 20. Due to the increased temperature together with the results of the injection of the solvent an easily flowable mixture has been formed. Now the lower drainage valve 13 of the production hole 7 is opened whilst maintaining the closure valve 12 closed, to make connection between the production hole 7 and the drainage channel 8 such that the mixture flows into the production hole 7 through the drainage channel 8 and down into the collecting chamber 9, from which collecting chamber 9 it will be pumped out via the collecting hole 5.

Figure 8:
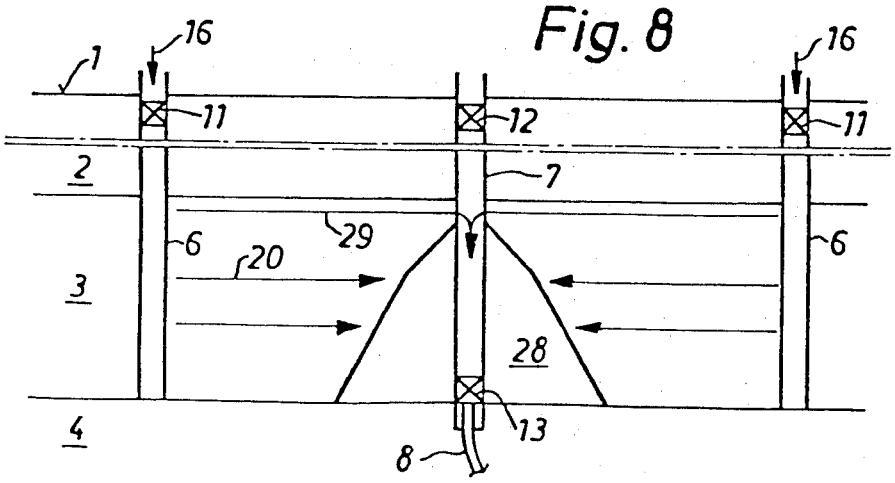
FIG. 8 shows a view similar to the view of FIG. 3, whereby the repeated injection of steam is shown.

In this way one operating cycle for the recovery of heavy oil is basically completed. Attention is now drawn to FIG. 8. Again the strata 3 carrying heavy oil are subjected to a pressure by the agency of injected steam 16 led into the injection holes 6. Thereby firstly a flowing through of steam from the injection holes 6 to the production hole 7 will take place and accordingly the exit of steam out of the injection holes 6 is closed off at locations adjacent to the underlying stratum 4 void of heavy oil. However, an entering of steam into the middle section of the strata 3 is allowed such as is shown with arrows 20. Accordingly, after a certain time span a flowing through of steam from the injection holes 6 to the production hole 7 occurs in the upper region of the strata 3 carrying heavy oil such as is shown by the arrow 29. After this has occurred, the injection of steam out of the injection holes 6 in mentioned upper area is terminated and further steam is injected only in the area identified by the arrows 20. Accordingly, a new, smaller cone 28 of heavy oil (including dissolved portions because obviously also a part of the solvent remains in the strata) is formed and the previously mentioned method steps are carried out once more. This whole procedure will be repeated several times until the complete annular section (see FIG. 2) contains no heavy oil. Thereupon a foamed material is injected in through the bore holes into the strata 3 having previously carried heavy oil. The reason thereto is to seal the mined portion against a flowing through of steam, heavy oil, etc. in a wrong, unwanted direction. Accordingly, one section after the other of the oil field is mined, whereby the entire work begins at the radially outermost ring of the section of the oil field in question and proceeds towards the collecting hole 5.

Figure 9:
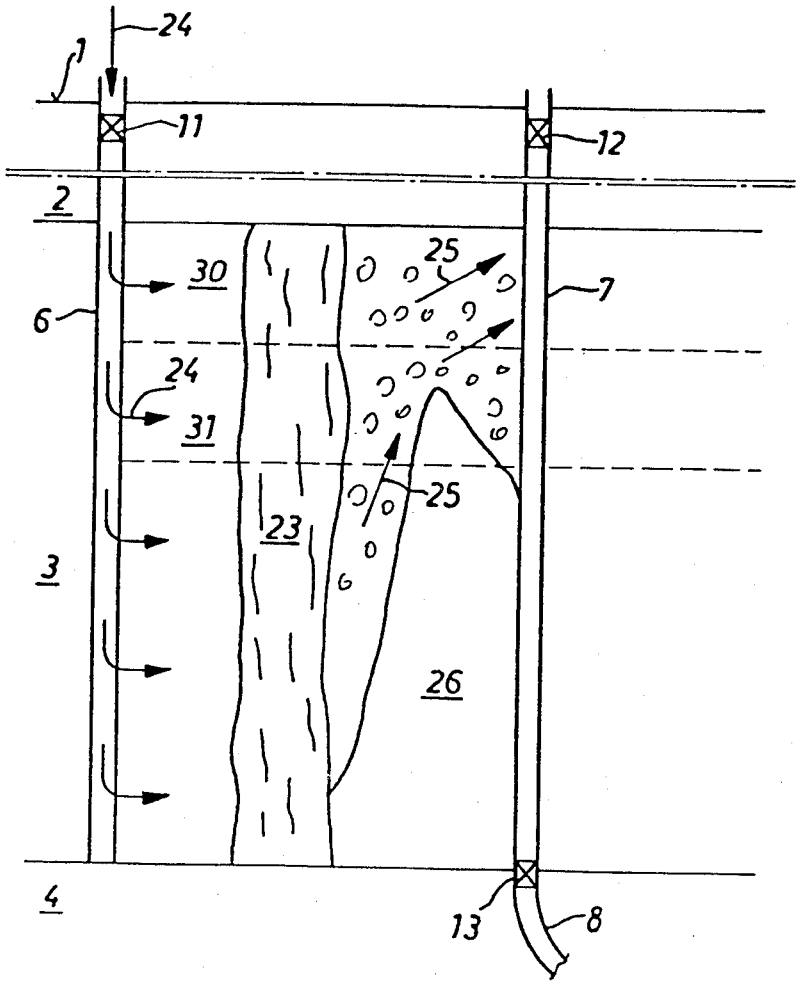
FIG. 9 shows a view similar to the view of FIG. 3, whereby the use of a fire front is shown.

In FIG. 9 there is shown a further embodiment whereby steam is not utilized. Here the method involving utilization of a fire front is carried out. A vertically extending fire front 23 is generated at the injection holes 6 in accordance with a known procedure. Thereby combustion gases 25 are generated, such that again pressure and temperature are exerted onto the heavy oil portions to be recovered, whereby again a cone 26 of flowable heavy oil is formed. The direction of the spreading of the fire front 23 is again controlled by means of fresh air 24, the locations of the entry of the fresh air out of the injection hole 6 into the strata 3 containing heavy oil as well as the direction of entry thereof is controlled selectively whereby again temperature feelers are utilized which are arranged in the production holes 7 (not shown in FIG. 9). Should a local blocking of the spreading of the fire front 23 occur, the area in question will be brought to a higher temperature by means of the previously mentioned radio frequency waves heating such to insure the spreading of the fire front 23. After the termination of the fire front 23 hot pressurized water will be injected through the injection holes 6 into the strata 3 carrying heavy oil. Thereby the closure valve 12 at the upper end of every production hole 7 as well as the corresponding drainage valve 13 is shut off. After the strata 3 carrying heavy oil are saturated by pressurized water, the injection valve 12 of every injection hole 6 is shut off, whereby the hot pressurized water is heated further by means of the heat generated by the fire front in the strata 3. It is important thereby that the temperature of the injected water is higher than about 105° C., whereby should this be necessary, a further heating by means of radio frequency waves is carried out to achieve this situation.

Thereafter the closure valve 12 and the drainage valve 13 of every production hole 7 are opened simultaneously, whereby simultaneously a communication between the injection holes 6 and a portion of the strata 3 carrying heavy oil is formed, which portion of the strata is identified in FIG. 9 by means of the reference numeral 30. Thereby a sudden pressure relief and obviously sudden flashing of the water into steam in this portion of the strata 30 occurs. In this way heavy oil is liberated and is driven against the respective production hole 7 through which it flows down through the drainage channel 8 into the collecting chamber 9. Thereafter the section 30 is filled with a foamed material and a sudden flashing into steam is carried out in the subsequent strata portion 31 located immediately below. This method is carried out step by step in a downwards direction against the stratum 4 void of heavy oil until the complete heavy oil content is driven out.

Also this method is carried out section 10 by section 10 such to recover completely the heavy oil thereof.

Figure 10:
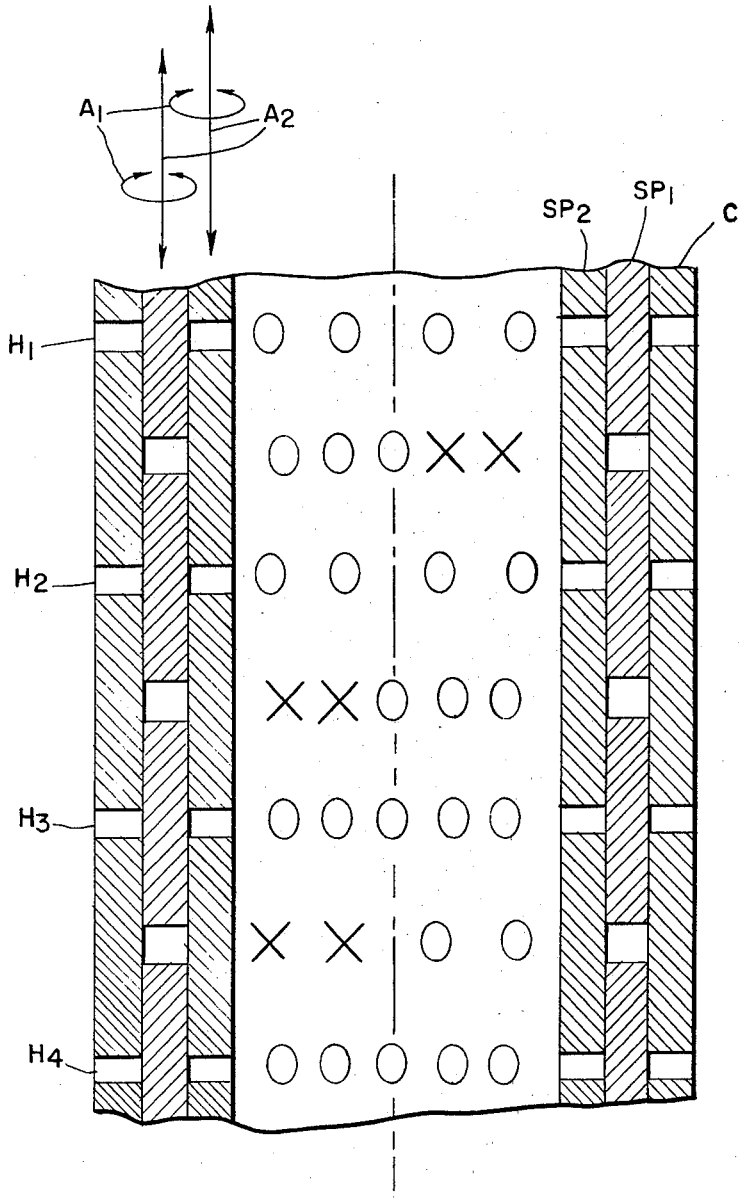
FIG. 10 shows a cross-section of a conventional spool valve construction usable to shut off flow in injection or production wells and to control directional characteristics of such wells.

FIG. 10 shows a spool valve construction usable in wells 6 and 7 to provide peripheral horizontal directional and vertical control as described above. The valve comprises a casing C and spools SPI and SPZ, both movable in directions indicated by arrows A1 and A2. The casing C has holes H1–H4. The spools have staggered holes which allow flow through all radial directions, all heights or for various permutations of cut off of some radial directions and/or some height locations of holes, as described above for system operation.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features in, or possessed by, the apparatus and techniques herein disclosed and limited solely by the scope and spirit of the appended claims.

What is claimed is:

1. A method of recovering heavy oil from a section of an oil-field containing oil bearing strata, comprising the steps of:

drilling a first bore hole (5) through said heavy oil containing strata (3) down into the underlying stratum (4) void of heavy oil, enlarging the end section of said first bore hole (5) located in said underlying stratum (4) such to provide a collecting chamber (9), drilling adjacent of said first bore hole (5) a plurality of second bore holes (6) through said heavy oil containing strata (3) in a pattern surrounding said first bore hole (6), drilling at locations between said second bore holes (6) in a pattern surrounding said first bore hole (5) a plurality of third bore holes (7) through said heavy oil containing strata (3), each said third bore holes (7) being followed by a drainage channel (8) leading to said collecting chamber (9), preheating a section of said heavy oil containing strata (3) located between said second (6) and said third bore holes (7), applying a pressure with simultaneous exertion of further heat, said pressure being directed from said second bore holes (6) to said third bore holes (7), whereby heavy oil rendered flowable thereby is transported towards said third bore holes (7) to flow therein through said drainage channels (8) and into said collection chamber (9) such to be extracted therefrom through said first bore hole (5), thereafter terminating said application of heat and pressure and subjecting said oil shale and tar sand strata (3) repeatedly to a scavenging action such to extract further heavy oil, filling the depleted section of said strata (3) by a foamed material.

2. The method of claim 1, wherein said preheating is carried out by an application of radio frequency waves generated by a radio frequency wave generating means (14) arranged in each said second bore holes (6), and wherein a cooling fluid is applied to the section of said strata (3) adjacent to and surrounding said radio frequency wave generating means to avoid a local overheating and consequent coking of heavy oil.

3. The method of claim 1, wherein the distribution of pressure within said strata (3) is monitored continuously, and wherein the locations of attack and the directions of force of said pressure are adjusted in accordance with the measured data.

4. The method of claim 3, wherein said monitoring of said distribution of the pressure within said strata (3) is carried out by measuring the temperature in each said third bore holes (7).

5. The method of claim 1, wherein said applying of pressure with simultaneous exertion of heat is generated by means of steam fed into said second bore holes (6).

6. The method of claim 1, comprising an injection of a heavy oil solvent from said third bore holes (7) at a location adjacent to said underlying stratum (4) void or heavy oil.

7. The method of claim 6, wherein said injection of said solvent is periodically interrupted by a further injection of steam from said second bore holes (6) such to drive further flowable heavy oil towards said third bore holes (7).

8. The method of claim 1, wherein a vertically extending fire front (23) is generated at said second bore holes (6), wherein the combustion gases (25) stemming therefrom generate said pressure with simultaneous exertion of heat.

9. The method of claim 8, wherein the distribution of said pressure and temperature generated by said gases (25) is controlled by a selective injection of combustion air (24) from said second bore holes (6).

10. The method of claim 8, wherein a local blocking of the spreading of said fire front (23) is overcome by a further application of heating by radio frequency waves.

11. The method of claim 9, wherein upon termination of said fire front (23) pressurized hot water is injected into said strata (3) at locations along the complete longitudinal extent of said second bore holes (6), said water being heated further by the heat generated by said fire front (23), whereby said second (6) and third bore holes (7) are shut off at the ground surface (1) and said third bore holes (7) are kept separated from their drainage channels (8).

12. The method of claim 11, wherein the temperature of said injected water is kept above a value of 105° C. by a further heating by means of radio frequency waves, and wherein all bore holes are kept in a shut off condition.

13. The method of claim 12, wherein said second (6) and said third bore holes (7) are brought into communication with the uppermost strata (3), and wherein simultaneously said third bore holes (7) are opened at ground surface (1) and are brought into communication with their drainage channels (8), whereby said second bore holes (6) are kept shut off at the ground surface (1) such that the pressure existing in said uppermost strata is relieved and a sudden flashing of said superheated water into steam is generated such that further heavy oil is liberated and driven against said third bore holes (4) such to flow into said collecting chamber (9), and wherein said strata depleted of heavy oil are filled by a foamed material.

14. The method of claim 13, wherein said pressure relieving, said sudden flashing into steam and said insertion of foamed material are carried through in several consecutive cycles, and wherein every cycle is executed at a consecutive adjacent location along said bore holes and thus in consecutively different strata containing heavy oil, proceeding from the uppermost strata carrying heavy oil and ending by the lowermost strata carrying heavy oil located adjacent said underlying stratum (4) free of heavy oil.

15. The method of claim 1, wherein during the application of pressure and simultaneous exertion of heat said third bore holes (7) are kept in communication with their drainage channels (8) and steam (17) is injected from said second bore holes (6) into the strata (3) containing heavy oil, followed by a closing off of said third bore holes (7) from said drainage channels (8) and an insertion of a heavy oil dissolving agent (19) from said third bore holes (7) at a location of said heavy oil containing strata (3) at a location adjacent said underlying stratum free of heavy oil (4), whereupon at a corresponding level further steam (20) is inserted from said second bore holes (6).

16. The method of claim 15, wherein said insertion of steam (17), said insertion of a dissolving agent (19) and said insertion of further steam (20) are carried out repeatedly until said heavy oil containing strata (3) are depleted of heavy oil.

17. The method of claim 15, wherein said depleted sections (3) are filled by a foamed material and the method of recovering heavy oil is continued at an adjoining section of said oil field.

18. Method of recovering underground oil in a selected region comprising the steps of forming a production well in such region, surrounded by injection wells, heating the oil, injecting pressurized fluid through said injection wells to drive oil in the region into a conical formation around the production well while closing off the production well to escape of oil, injecting cold solvent via the production well into a lower section of the conical formation and maintaining the formation intact to prevent escape of heat and allow thorough mixing of the solvent with the oil, heating the oil/solvent mixture and opening the production well and terminating solvent injection to allow escape of oil/solvent mixture through the production well.

19. Method of claim 18 carried out repetitively in said selected region.

20. Method of claims 18 or 19 followed by the step of backfilling the selected region with solid material after oil removal therefrom.

* * * * *